US009114269B2

(12) United States Patent
Lin et al.

(10) Patent No.: US 9,114,269 B2
(45) Date of Patent: Aug. 25, 2015

(54) ELECTRONIC SKIPPING ROPE STRUCTURE AND COMPETITION SYSTEM THEREFOR

(75) Inventors: Peilin Lin, Guangdong (CN); Tianlu Wang, Guangdong (CN); Shantang Lin, Guangdong (CN)

(73) Assignee: Peilin Lin, Shenzhen (CN)

( * ) Notice: Subject to any disclaimer, the term of this patent is extended or adjusted under 35 U.S.C. 154(b) by 91 days.

(21) Appl. No.: 14/008,000

(22) PCT Filed: Mar. 29, 2012

(86) PCT No.: PCT/CN2012/073248

§ 371 (c)(1),
(2), (4) Date: Sep. 27, 2013

(87) PCT Pub. No.: WO2012/130147

PCT Pub. Date: Oct. 4, 2012

(65) Prior Publication Data

US 2014/0018210 A1 Jan. 16, 2014

(30) Foreign Application Priority Data

Mar. 31, 2011 (CN) ..... 2011 1 0080750

(51) Int. Cl.
*A63B 5/20* (2006.01)
*A63B 71/06* (2006.01)

(52) U.S. Cl.
CPC ..... *A63B 5/20* (2013.01); *A63B 71/0605* (2013.01); *A63B 2220/17* (2013.01); *A63B 2220/833* (2013.01); *A63B 2225/50* (2013.01)

(58) Field of Classification Search
CPC .. A63B 5/20; A63B 2225/50; A63B 2220/17; A63B 2220/833; A63B 71/0605
USPC ..... 482/1–9, 82, 83, 900–902; 434/247
IPC ..... A63B 5/20
See application file for complete search history.

(56) References Cited

U.S. PATENT DOCUMENTS

| | | | | |
|---|---|---|---|---|
| 5,533,947 | A * | 7/1996 | Tomlinson et al. | 482/6 |
| 7,354,383 | B2 * | 4/2008 | Bardha | 482/82 |
| 7,892,145 | B2 * | 2/2011 | Lovett et al. | 482/3 |
| 2011/0130247 | A1 * | 6/2011 | Lovett et al. | 482/3 |
| 2013/0288860 | A1 * | 10/2013 | Massey | 482/82 |

OTHER PUBLICATIONS

International Search Report of PCT Application No. PCT/CN2012/073248.

* cited by examiner

*Primary Examiner* — Glenn Richman

(57) ABSTRACT

Disclosed is an electronic skipping rope structure comprising two skipping rope handles (1A, 1B) and a rope (2). The skipping rope handles (1A, 1B) each comprise a fixed handle (10) for being grasped and a rotating body (11) which is movably connected with the fixed handle (10) and is connected with the rope (2). A sensing point (11A, 11B, 11C) is arranged on the rotating body (11) of one skipping rope handle (1A), and at least two detecting points (10A, 10B, 10C) corresponding to the sensing point (11A, 11B, 11C) are arranged on the fixed handle (10) of the skipping rope handle (1A), said fixed handle (1A) having arranged inside it a micro-controller (3) electrically connected with the detecting points (10A, 10B, 10C). The electronic skipping rope structure increases the accuracy of counting and features a simple structure and low costs. Also provided is an electronic skipping rope competition system.

18 Claims, 15 Drawing Sheets

ELECTRONIC SKIPPING ROPE STRUCTURE AND COMPETITION SYSTEM THEREFOR

FIELD OF THE INVENTION

The present invention relates to an electronic skipping rope structure and a competition system including such an electronic skipping rope structure, and more particularly to an electronic skipping rope structure which uses at least two detecting points to achieve counting, and an electronic skipping rope competition system including such an electronic skipping rope structure.

BACKGROUND OF THE INVENTION

The scoring method of existing electronic skipping rope is single point detecting which is achieved by just detecting one point during the rope rotating for one circle. During the jumper doing rope skipping, the rope is not always rotating along a same direction. When the hands of the jumper is shaking, a rotating body (movable end for fixing the rope) of the handle is likely to rotate back and forth, thus brings inaccurate counting results. For example, the jumping person jumped 200 times, but the counting result may be 210 times. Such an unscientific way of counting will produce an unfair result in rope skipping competition or examination.

Additionally, in existing rope skipping competition, besides the detection of the handle, and sometimes will further require the jumping person to make the rope hit the ground. However, existing electronic skipping rope does not have such a function to meet the needs of the competition and examination of this kind.

In view of the above-mentioned disadvantages of the existing technology, the applicant develops an electronic skipping rope structure with reliable counting function, and a skipping competition system including such an electronic skipping rope structure.

SUMMARY OF THE INVENTION

One object of the present invention is to provide an electronic skipping rope structure with more reliable counting function, so as to overcome the disadvantages of the existing technology.

Another object of the present invention is to provide a skipping rope competition system constituted by the above-mentioned electronic skipping rope structure.

To achieve above-mentioned objects, the present invention adopts the following technical solutions:

An electronic skipping rope structure includes two skipping rope handles and a rope arranged between the two skipping rope handles, the skipping rope handles each including a fixed handle for being grasped by the hands of a jumping person and a rotating body movably connected with the fixed handle, the rotating body being connected with the rope, wherein a sensing point is arranged on the rotating body of one skipping rope handle, at least two detecting points corresponding to the sensing point are arranged on the fixed handle of said skipping rope handle, and a micro-controller electrically connected with the detecting points is arranged inside said fixed handle.

Its further technical solution is: the number of said detecting points is three.

Its further technical solution is: three circular slideways are arranged at different positions along the axial direction of said rotating body, each circular slideway having one sensing point arranged therein, each sensing point being connected with a common signal terminal arranged on the rotating body; and the fixed handle has three elastic sheets respectively corresponding to said three circular grooves, each of said elastic sheets being connected with the micro-controller.

Its further technical solution is: said rotating body has a protruding block arranged thereon and said fixed handle has three elastic sheet switches arranged at a circular position corresponding to the protruding block, said three elastic sheet switches all being connected with the micro-controller; and said elastic sheet switches constitutes the detecting points. Wherein, the magnetic sensor could be reed switch or Hall switch (also be called as Hall sensor).

Its further technical solution is: the micro-controller includes a counting circuit connected with the detecting points, and further includes a memory, a wireless communication module, a control button, a display screen and a buzzer all connected with the micro-controller, the wireless communication module being wirelessly connected with a skipping rope console.

Its further technical solution is: the rope is a conductive body; the micro-controller includes a counting circuit connected with the detecting points, and further includes a memory, a transceiver circuit, a control button, a display screen and a buzzer all connected with the micro-controller, the transceiver circuit being electrically connected with the rope.

Its further technical solution is: the transceiver circuit includes a receiving amplifying circuit and a single-line transmitting IC chip, both of which are connected with the micro-controller, said receiving amplifying circuit being a multi-level triode amplifying circuit, said single-line transmitting IC chip being a chip of SN8P2501-8 type, and the micro-controller being a chip of HT46R62 type.

An electronic skipping rope competition system, including a skipping rope console and an aforementioned electronic skipping rope structure, wherein the skipping rope console includes a processor and a power supply module, a control bottom, a memory, a transmitting-receiving module and a display screen all connected with the processor, and said skipping rope console is connected with an conductive skipping blanket connected with the transmitting-receiving module, said conductive skipping blanket communicating with the rope via non-earthed contact electromagnetic wave communication mode, and the signal transmitted between the conductive blanket and rope being pulse electrical signal with frequency between 800 k and 2 MHz.

An electronic skipping rope competition system including a skipping rope console and an aforementioned electronic skipping rope structure, wherein the skipping rope console includes a processor and a power supply module, a control bottom, a memory, a wireless communication module and a display screen, all of which are connected with the processor.

An electronic skipping rope competition system including a skipping rope console and an aforementioned electronic skipping rope structure, wherein the skipping rope console includes a processor and a power supply module, a control bottom, a memory, a display screen and more than one contact-press type switches, all of which are connected with the processor, and further includes a skipping blanket for containing the contact-press type switches.

Compared with the prior art, the beneficial technical effects of the present invention include: with respect with the electronic skipping rope structure of the present invention, due to the three detecting points arranged in 360 degree, only when the rope has completely rotated for one circle, can the rope skipping be counted once. Thus the counting of rope skipping achieved by the skipping rope handle is accurate. It has simple structure and low cost, and is easy to be applied on various competitions and examinations of rope skipping. With respect to the electronic skipping rope competition system of the present invention, it can transmit the counting results of the skipping rope handles to a console in real time by such detection modes as non-earthed contact electromagnetic wave communication, wireless communication or contact-press type switches, such that results are displayed to the examiner or audiences via a display screen of the console. The user is unaffected when skipping and operation is convenient.

The present invention will become more clear by means of the following description combining the accompanying drawings, which are used to illustrate embodiments of the present invention.

Figure 6A:
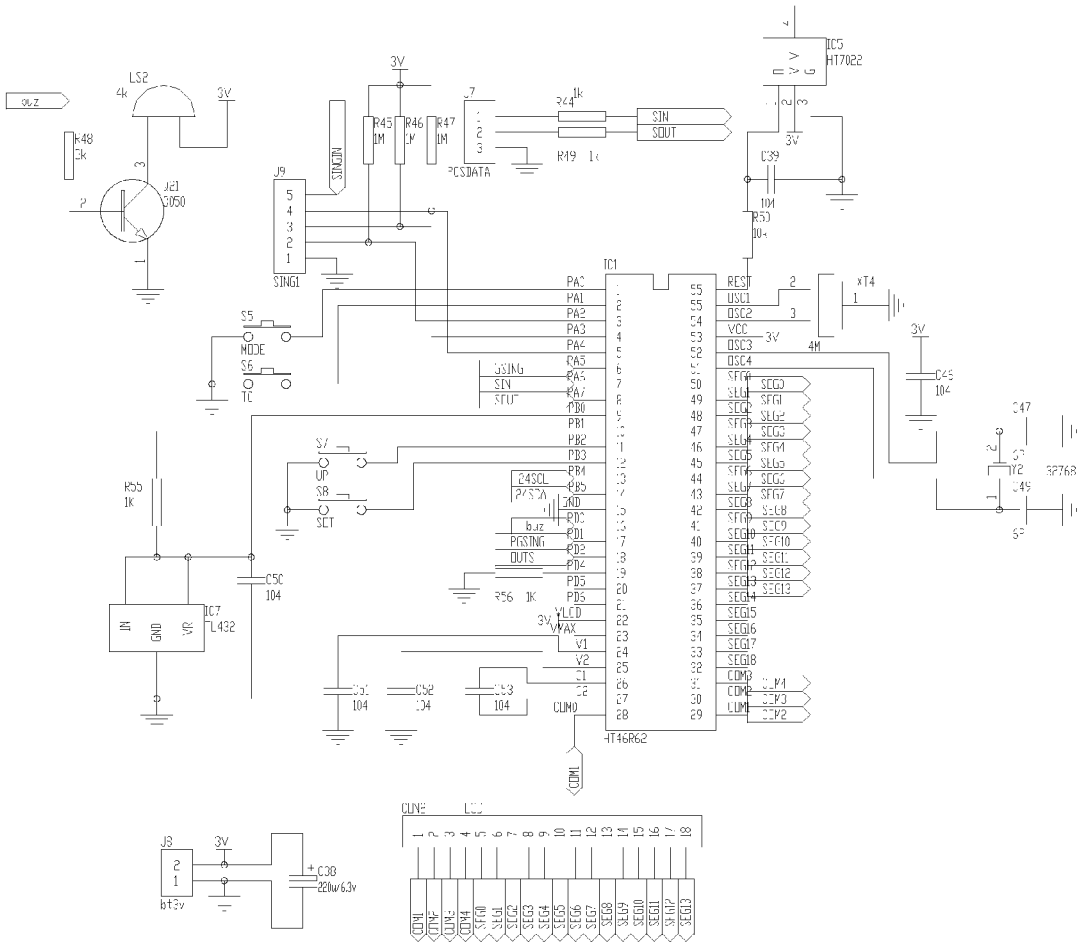
Figure 6B:
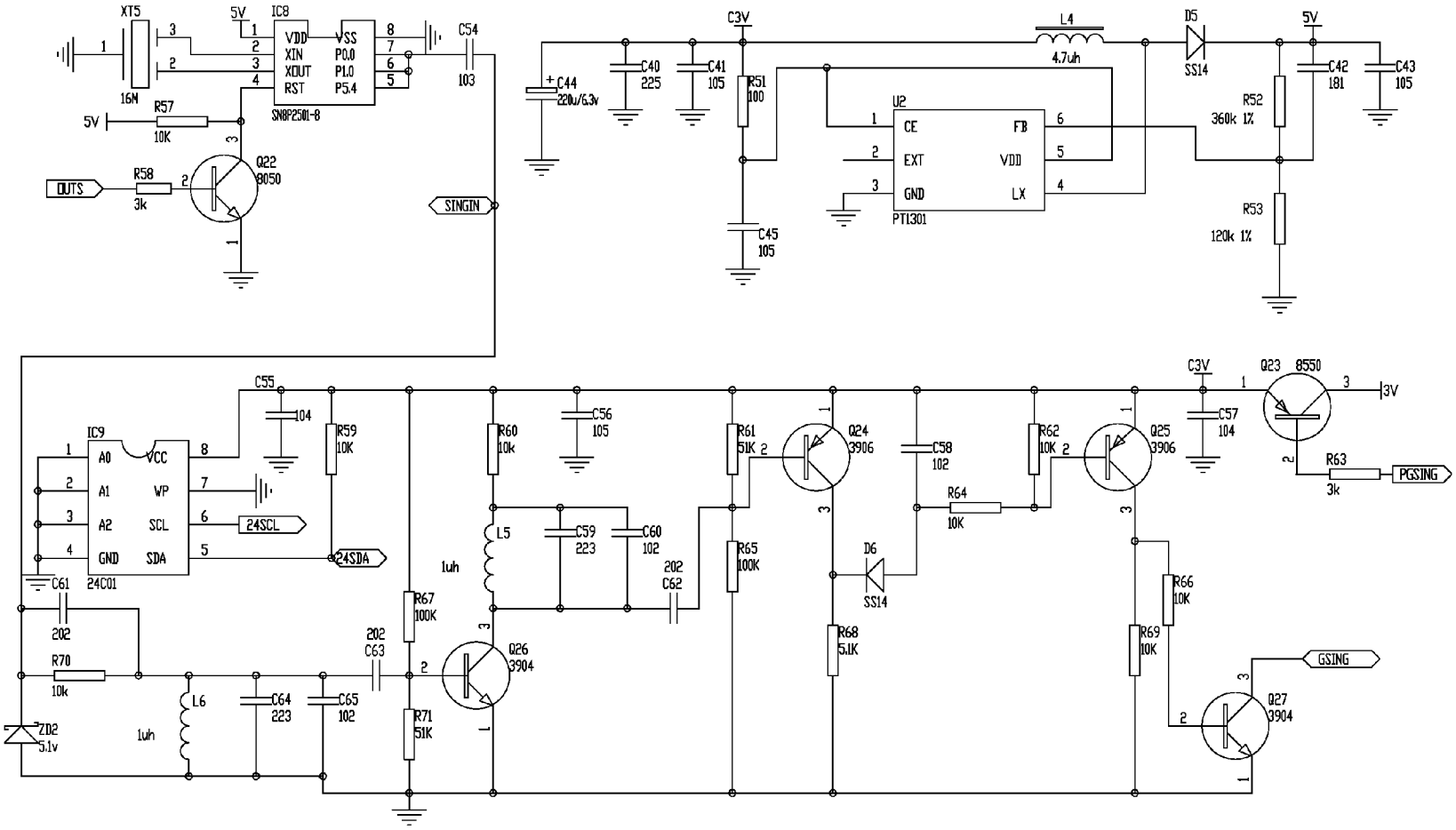
Figure 7A:
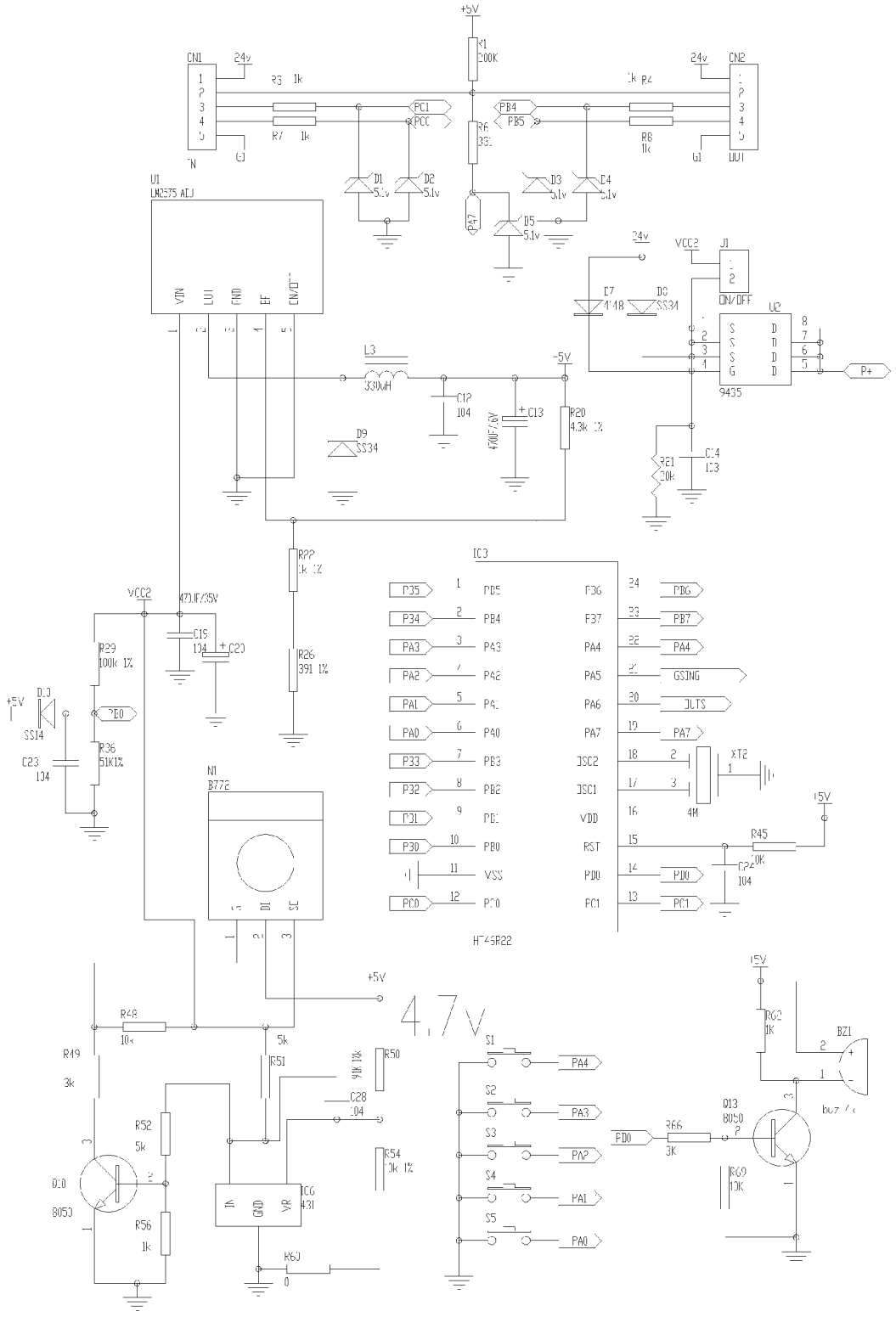
Figure 7B:
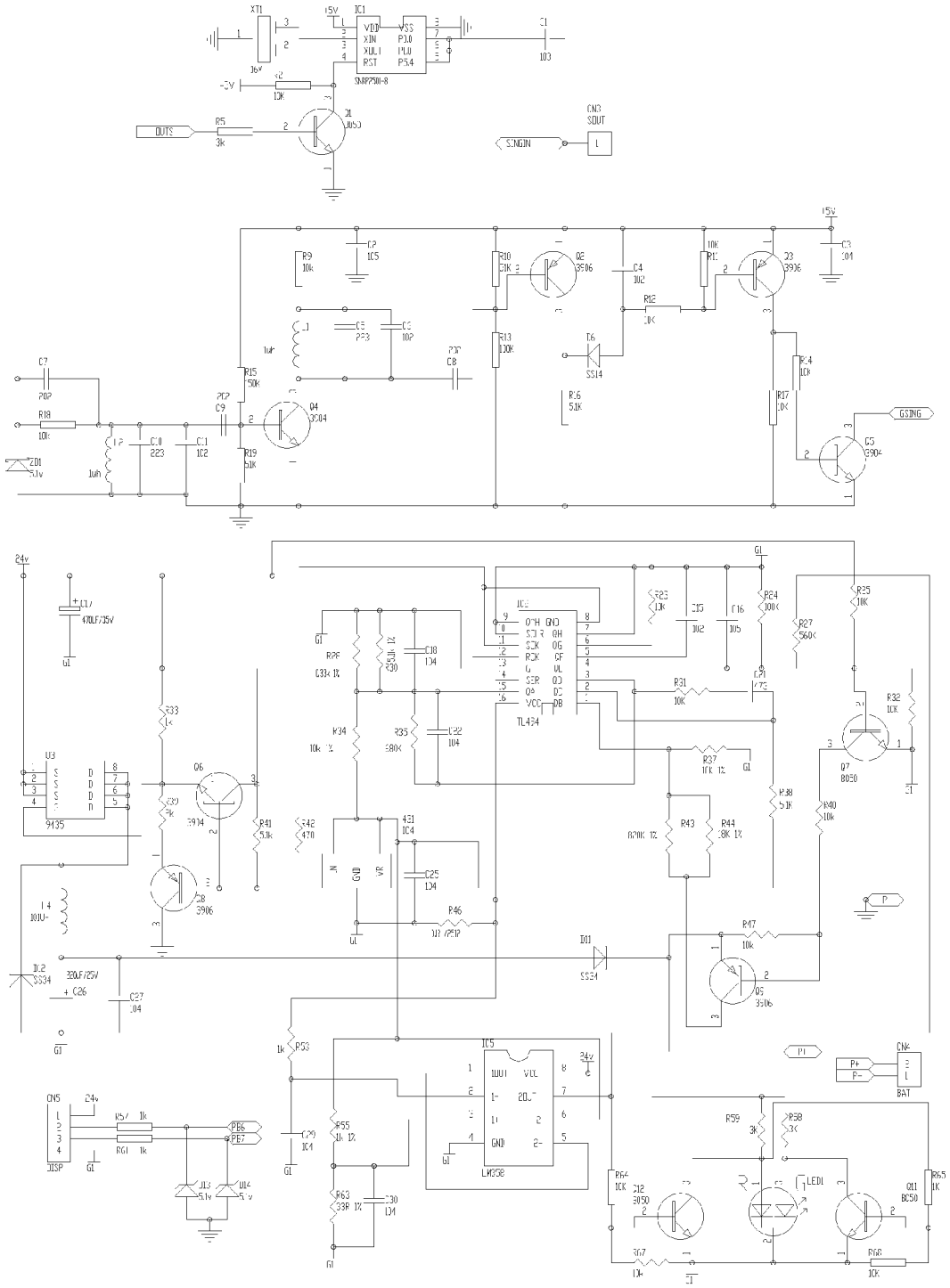
Figure 7C:
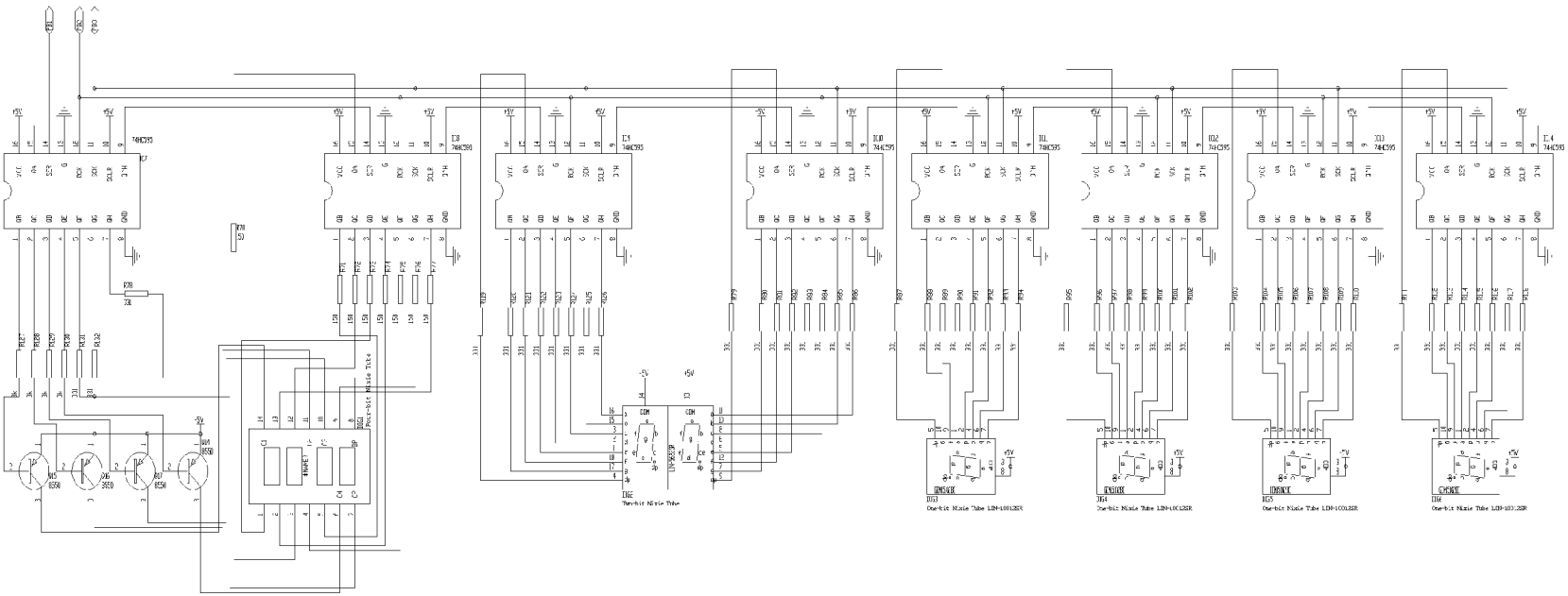
Figure 8:
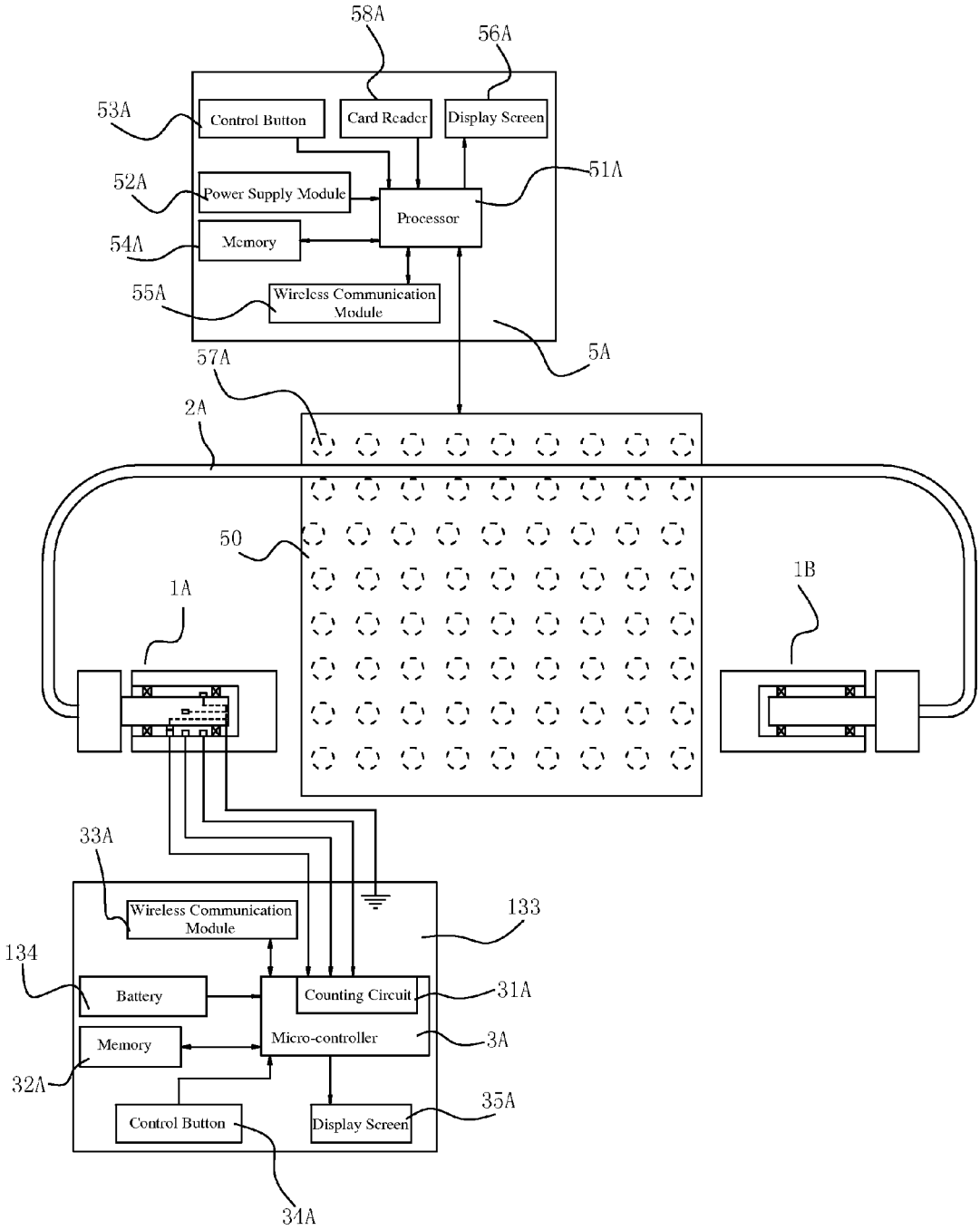
Figure 9:
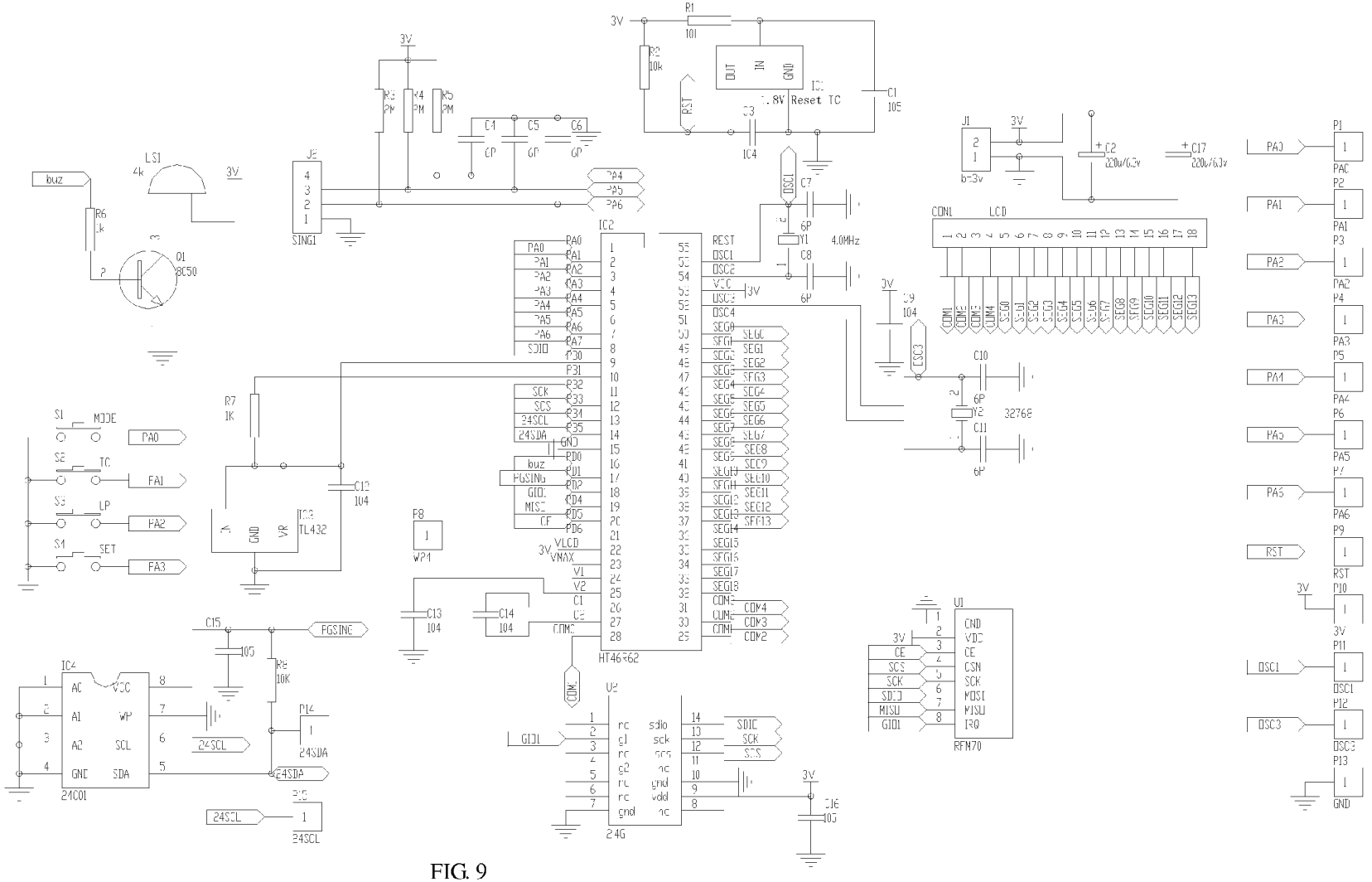
Figure 10A:
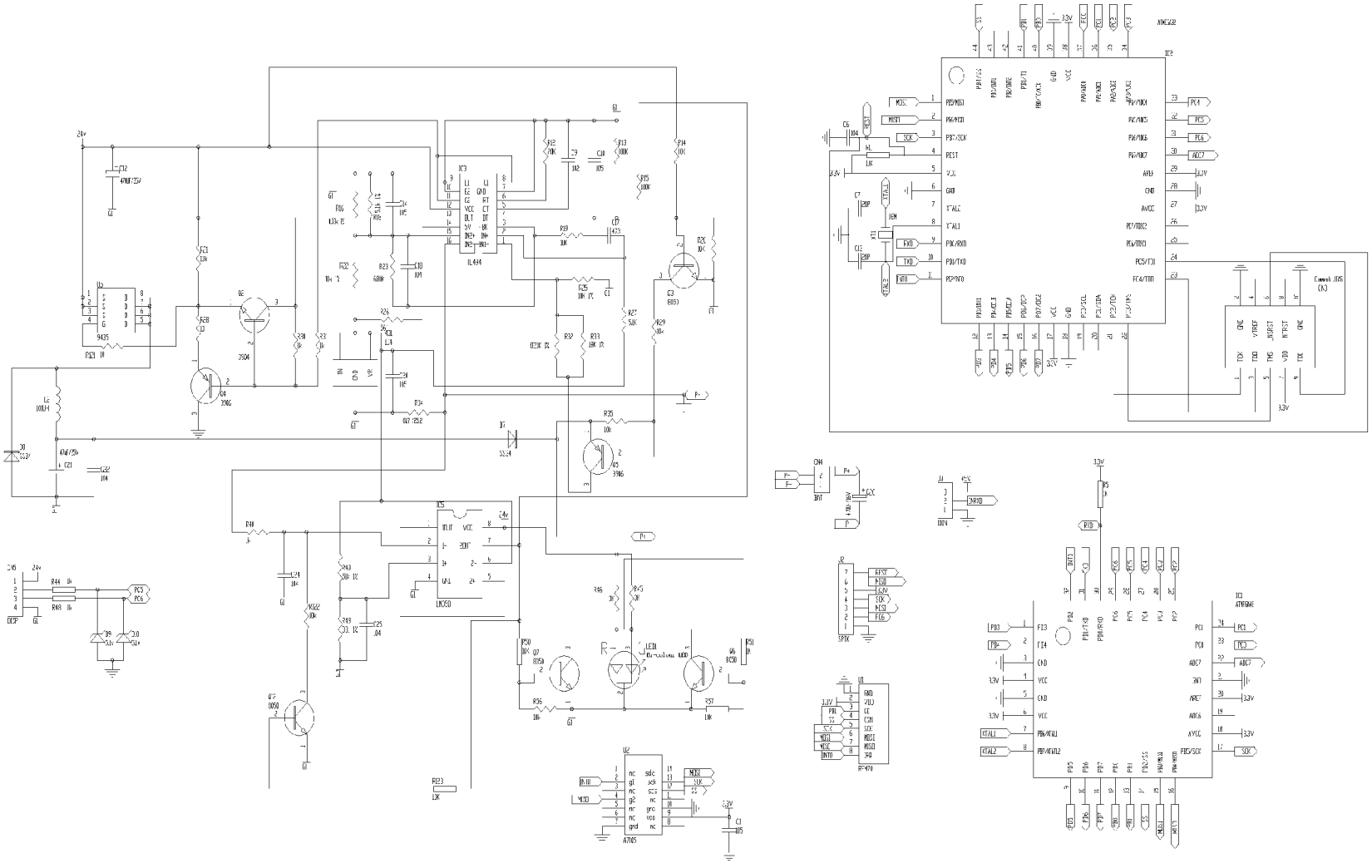
Figure 10B:
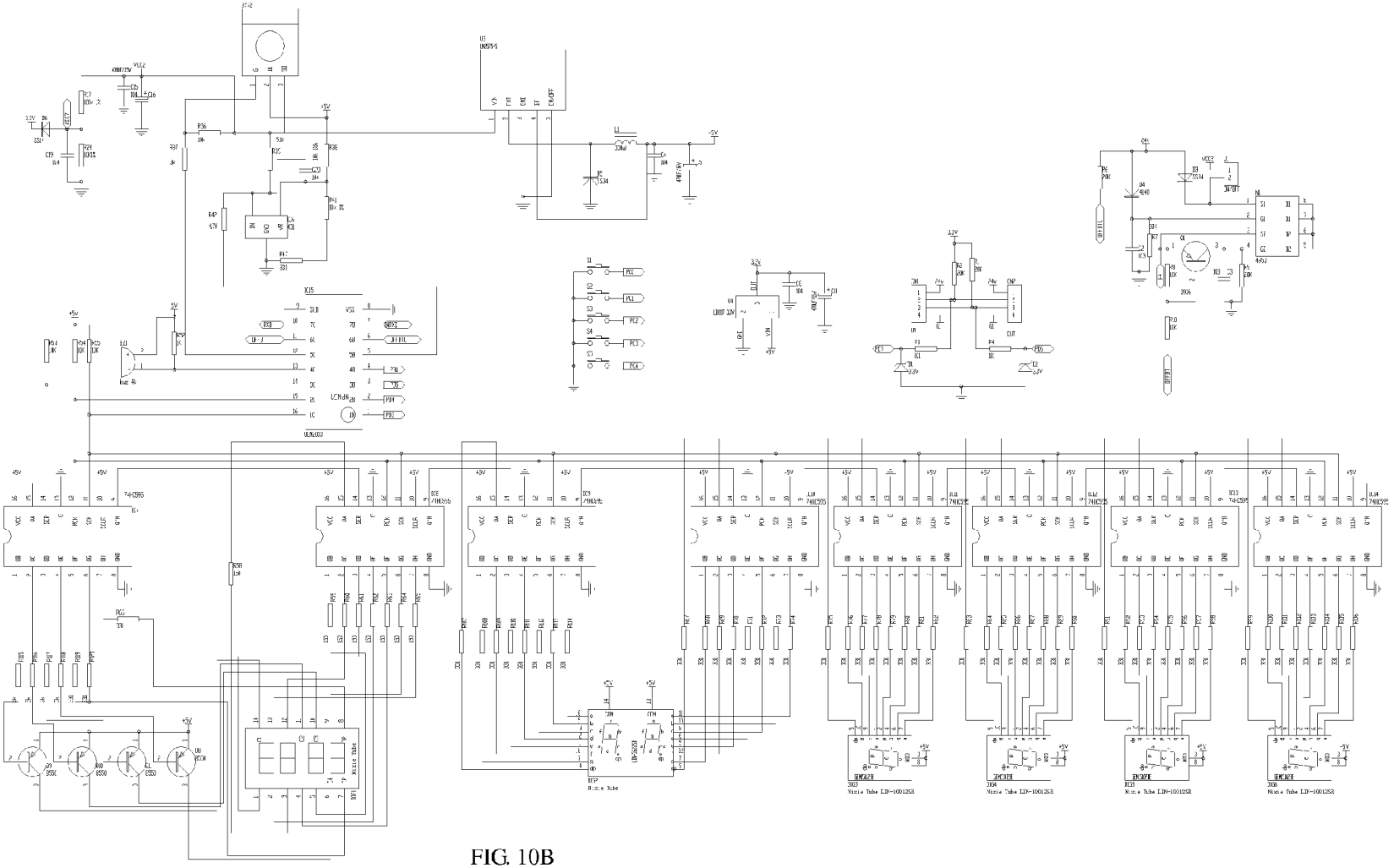

FIG .5 is a structure block diagram of an electronic skipping rope competition system according to an embodiment of the present invention (using non-earthed contact electromagnetic wave communication mode);

FIG. 6A is a first schematic circuit diagram of the skipping rope handle of the electronic skipping rope competition system according to an embodiment of the present invention (using non-earthed contact electromagnetic wave communication mode);

FIG. 6B is a second schematic circuit diagram of the skipping rope handle of the electronic skipping rope competition system according to an embodiment of the present invention (using non-earthed contact electromagnetic wave communication mode);

FIG. 7A is a first schematic circuit diagram of the skipping rope console of the electronic skipping rope competition system according to an embodiment of the present invention (using non-earthed contact electromagnetic wave communication mode);

FIG. 7B is a second schematic circuit diagram of the skipping rope console of the electronic skipping rope competition system according to an embodiment of the present invention (using non-earthed contact electromagnetic wave communication mode);

FIG. 7C is a third schematic circuit diagram of the skipping rope console of the electronic skipping rope competition system according to an embodiment of the present invention (using non-earthed contact electromagnetic wave communication mode);

FIG. 8 is a structure block diagram of the electronic skipping rope competition system according to an embodiment of the present invention (using wireless communication mode);

FIG. 9 is a schematic circuit diagram of the skipping rope handle of the electronic skipping rope competition system according to an embodiment of the present invention (using wireless communication mode);

FIG. 10A is a first schematic circuit diagram of the skipping rope console of the electronic skipping rope competition system according to an embodiment of the present invention (using wireless communication mode);

FIG. 10B is second schematic circuit diagram of the skipping rope console of the electronic skipping rope competition system according to an embodiment of the present invention (using wireless communication mode).

DESCRIPTION OF THE REFERENCE NUMBERS IN THE ACCOMPANYING DRAWINGS

Skipping rope handles 1A, 1B; fixed handle 10; rotating body 11; detecting points 10A, 10B, 10C; sensing points 11A, 11B, 11C; bearing 12; rope 2; micro-controller 3; turncap 119; handle shell 13; spring 131; load rod 132; circuit board 133; battery 134; buzzer 135; common grounded wire 109; snap spring 119; switch housing 108; elastic sheet switches 101D, 102D, 103D; projecting block 11D; protruding block 11D; circular slideways 111A, 112A, 113A; elastic sheets 101A, 102A, 103A; magnetic sensors 101B, 102B, 103B; magnets 111B, 112B, 113B; sliding ring sleeve 104; sliding ring inner sleeve 104A; sliding ring outer sleeve 104B; sliding ring portion 114; counting circuit 31; memory 32; transceiver circuit 33; control button 34; display screen 35; skipping rope console 4; processor 41; power supply module 42; control bottom 43; memory 44; transmitting-receiving module 45; display screen 46; conductive skipping blanket 5; micro-controller 3A; counting circuit 31A; memory 32A; wireless communication module 33A; control button 34A; display screen 35A; skipping rope console 5A; processor 51A; power supply module 52A; control bottom 53A; memory 54A; wireless communication module 55A; display screen 56A; conductive blanket 57A; display screen 56A; contact-press type switch 57A; blanket (non-conductive); rope (non-conductive); card reader 58A.

DETAILED DESCRIPTION OF ILLUSTRATED EMBODIMENTS

For understanding the technical content of the present invention more sufficiently, some embodiments of the present invention will now be described as follows, by way of example only, with reference to the accompanying drawings.

Figure 1:
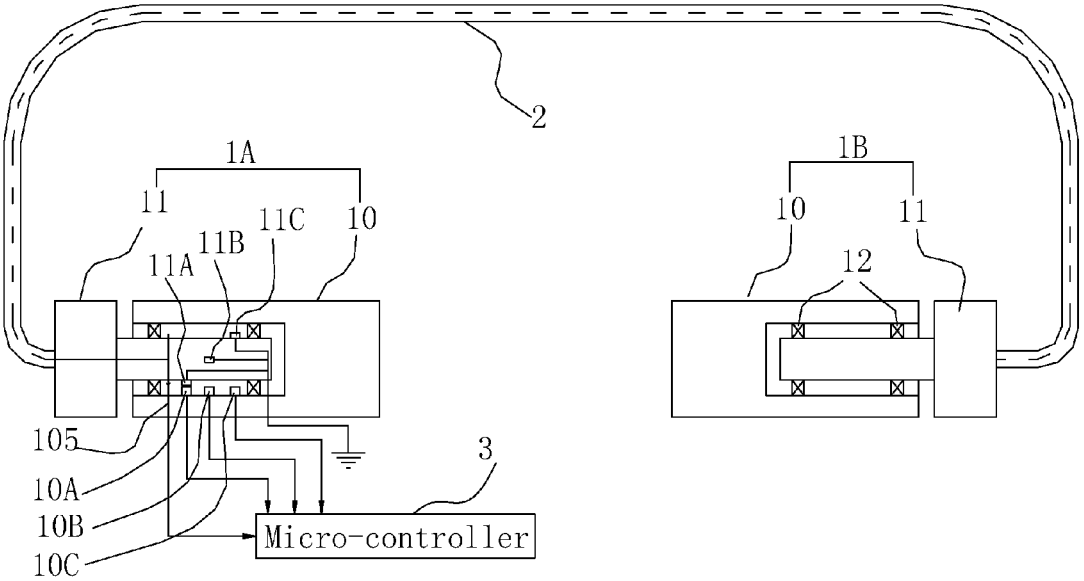
FIG. 1 is a structure diagram of an electronic skipping rope structure according to an embodiment of the present invention.
Figure 1A:
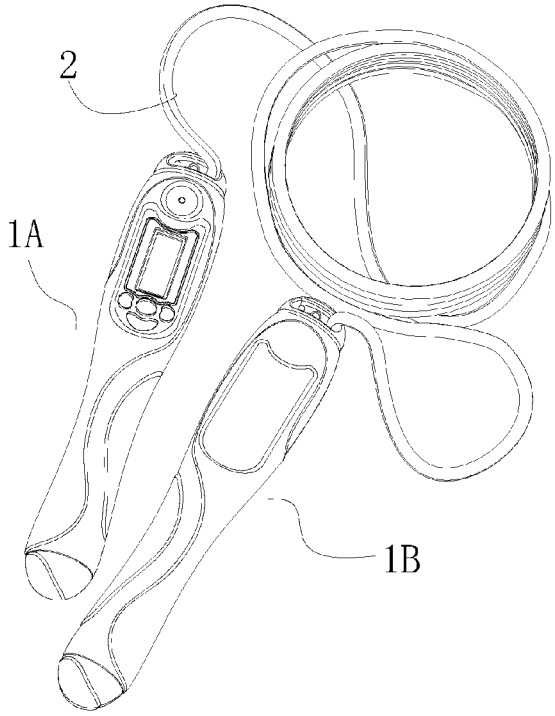
FIG. 1A is a perspective view of the electronic skipping rope structure according to an embodiment of the present invention.
Figure 1B:
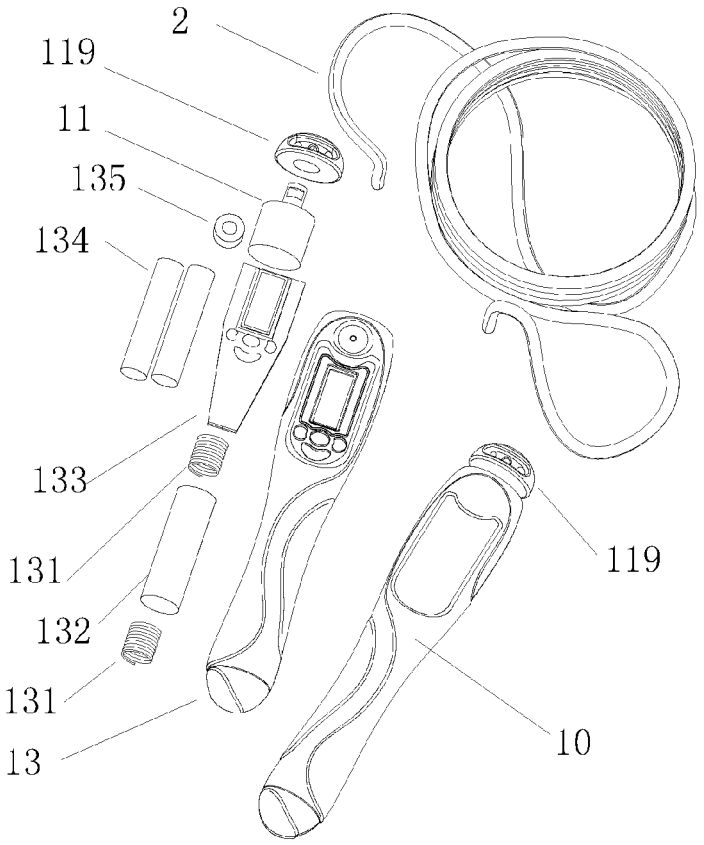
FIG. 1B is an exploded perspective view of the electronic skipping rope structure according to an embodiment of the present invention.

An electronic skipping rope structure according to an embodiment of the present invention is shown in FIG. 1. The electronic skipping rope structure of the present invention includes two skipping rope handles 1A, 1B and a rope 2 arranged between the two skipping rope handles 1A, 1B. Each of the skipping rope handles 1A, 1B includes a fixed handle 10 for being grasped by the hands of a jumping person and a rotating body 11 movably connected with the fixed handle 10, the rotating body 11 being connected with the rope 2. Sensing points 11A, 11B, 11C are arranged on the rotating body 11 of one of the skipping rope handles (take the skipping rope handle 1A for example), and three detecting points 10A, 10B, 10C respectively corresponding to the sensing points 11A, 11B, 11C are arranged on the fixed handle 10 of the skipping rope handle 1A. The fixed handle 1A further includes a micro-controller 3 arranged there inside, which is electrically connected with the detecting points 10A, 10B, 10C. Wherein, the rotating body 11 is fixed on the fixed handle 10 via a bearing 12.

Figure 3A:
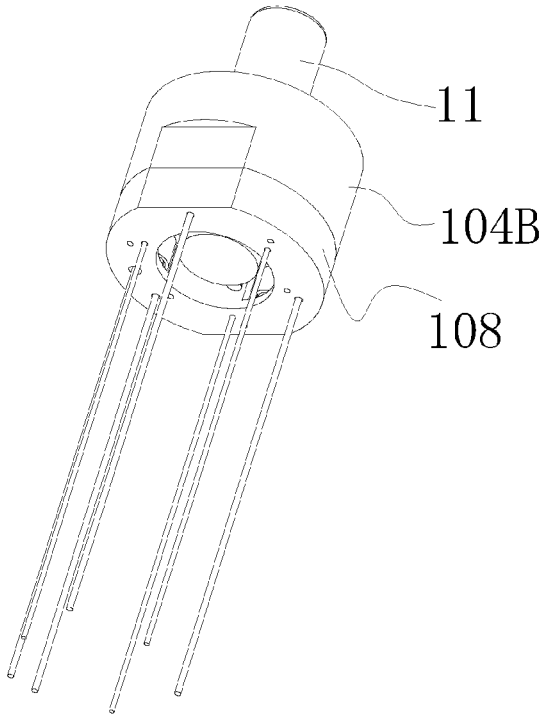
FIG. 3A is a partial perspective view of the electronic skipping rope structure including an elastic sheet structure according to an embodiment of the present invention.
Figure 3B:
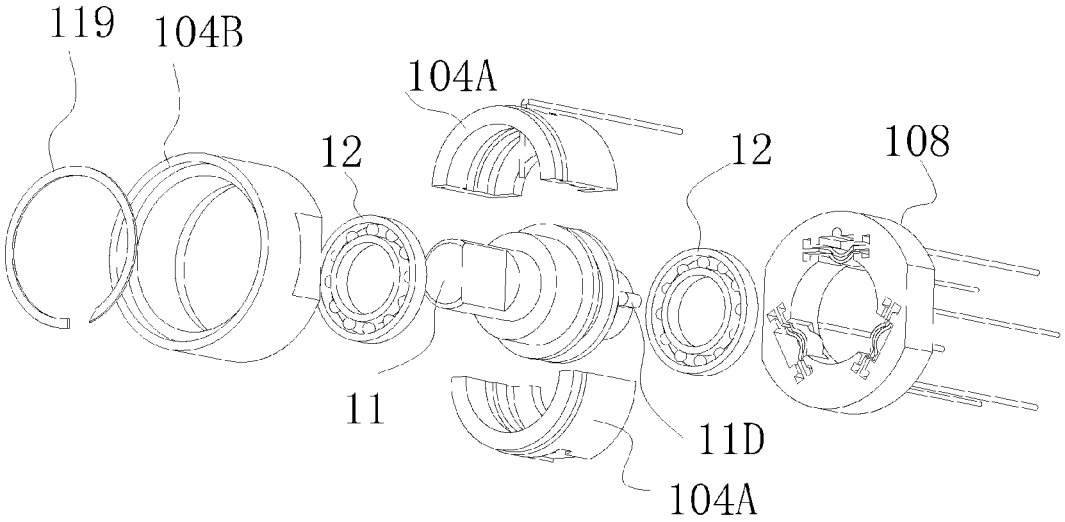
FIG. 3B is an exploded view of FIG. 3A.
Figure 3C:
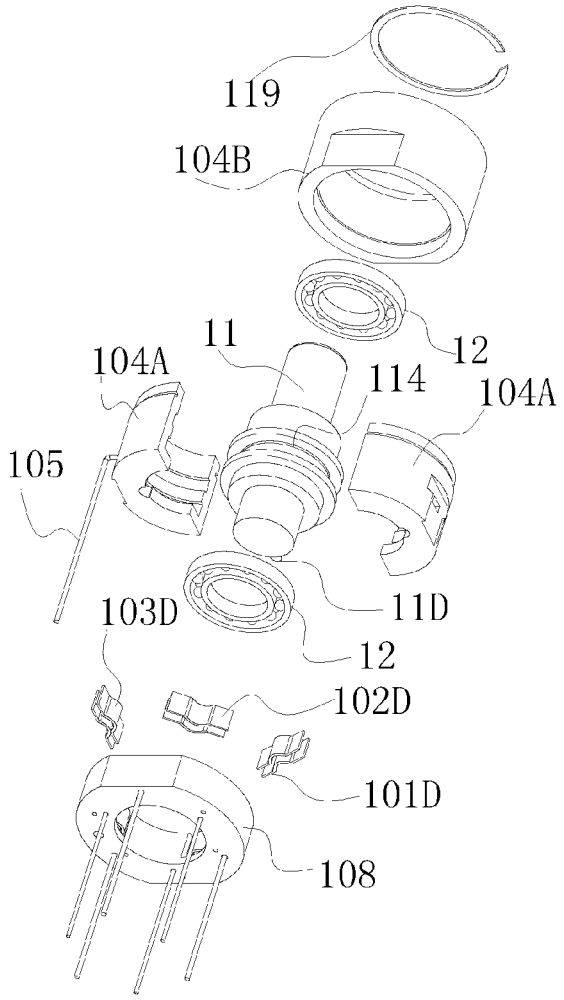
FIG. 3C is an exploded view of FIG. 3B for another perspective.

If the three detecting points are arranged at the same axial position, only one sensing point is needed. But the three detecting points need to be arranged at different rotation angles of the same axial position, and one best way to achieve this could be the three detecting points being staggered 120 degrees with each other. For example, the electronic skipping rope structure including an elastic sheet structure according to an embodiment of the present invention is shown in FIG. 3A to FIG. 3C. In this embodiment, the three sensing points (the three elastic sheet switches 101D, 102D, 103D) are all connected with the micro-controller 3. The detecting principle is: during the rotating body rotating for one circle, the sensing point (protruding block 11D) of the rotating body 11 contacts and presses the three elastic sheet switches 101D, 102D, 103D, orderly. When orderly receiving the input signals from the elastic sheet switches 101D, 102D, 103D, the micro-controller 3 counts once and continues to count by this way. If one of the detecting points produces multiple detecting signals because of shaking, the micro-controller 3 only records one detecting signal. Only rotating continuously can it be reset and detected one by one, thereby achieving counting effectively. The three elastic sheet switches 101D, 102D, 103D are fixed by an elastic sheet case 108 which is also used for fixing the wire of each detecting point.

Figure 2A:
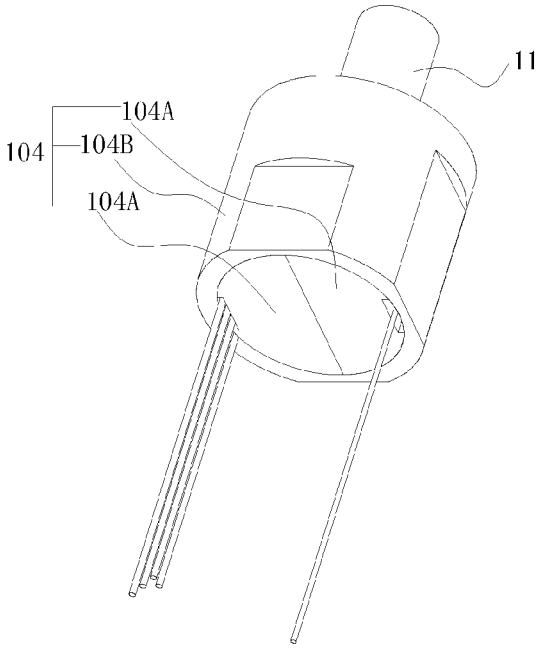
FIG. 2A is a partial perspective view of the electronic skipping rope structure including a slideway structure according to an embodiment of the present invention.
Figure 2B:
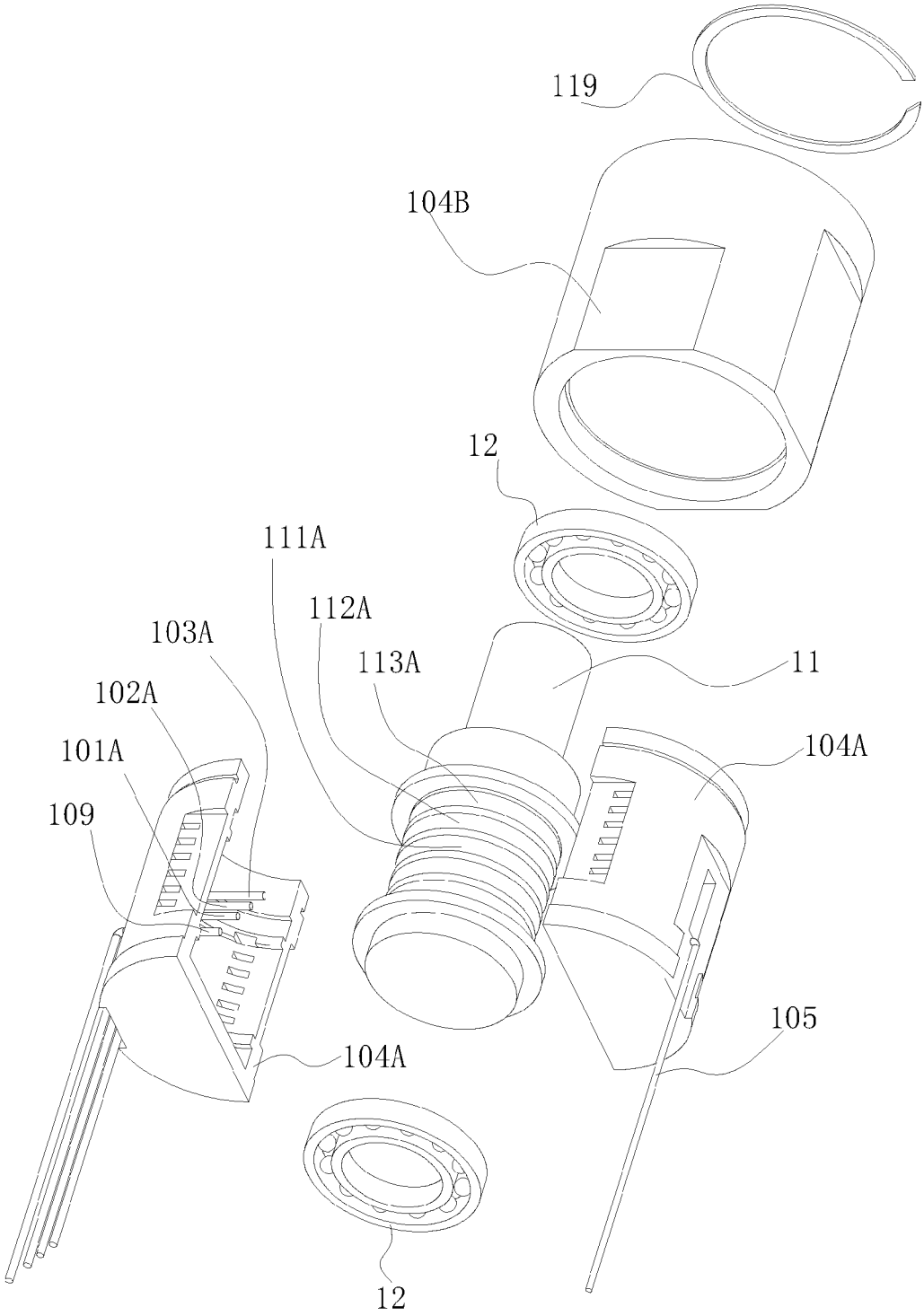
FIG. 2B is an exploded enlarged view of FIG. 2A.
Figure 4A:
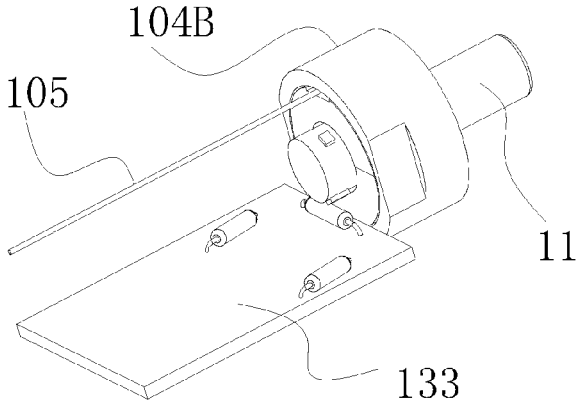
FIG. 4A is a partial perspective view of the electronic skipping rope structure including a magnet structure according to an embodiment of the present invention.
Figure 4B:
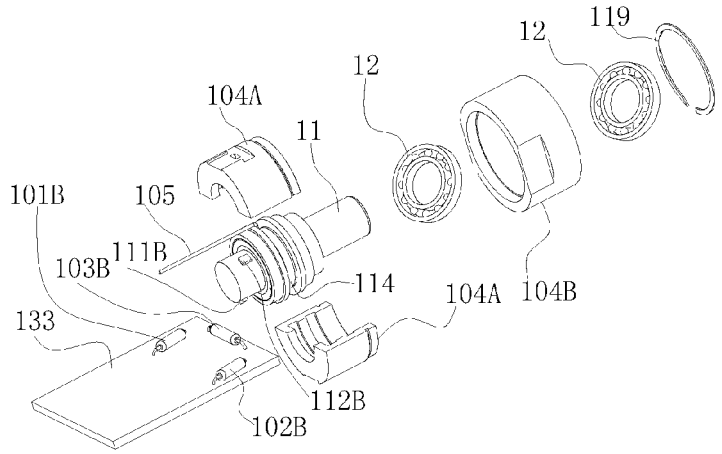
FIG. 4B is an exploded view of FIG. 4A.
Figure 5:
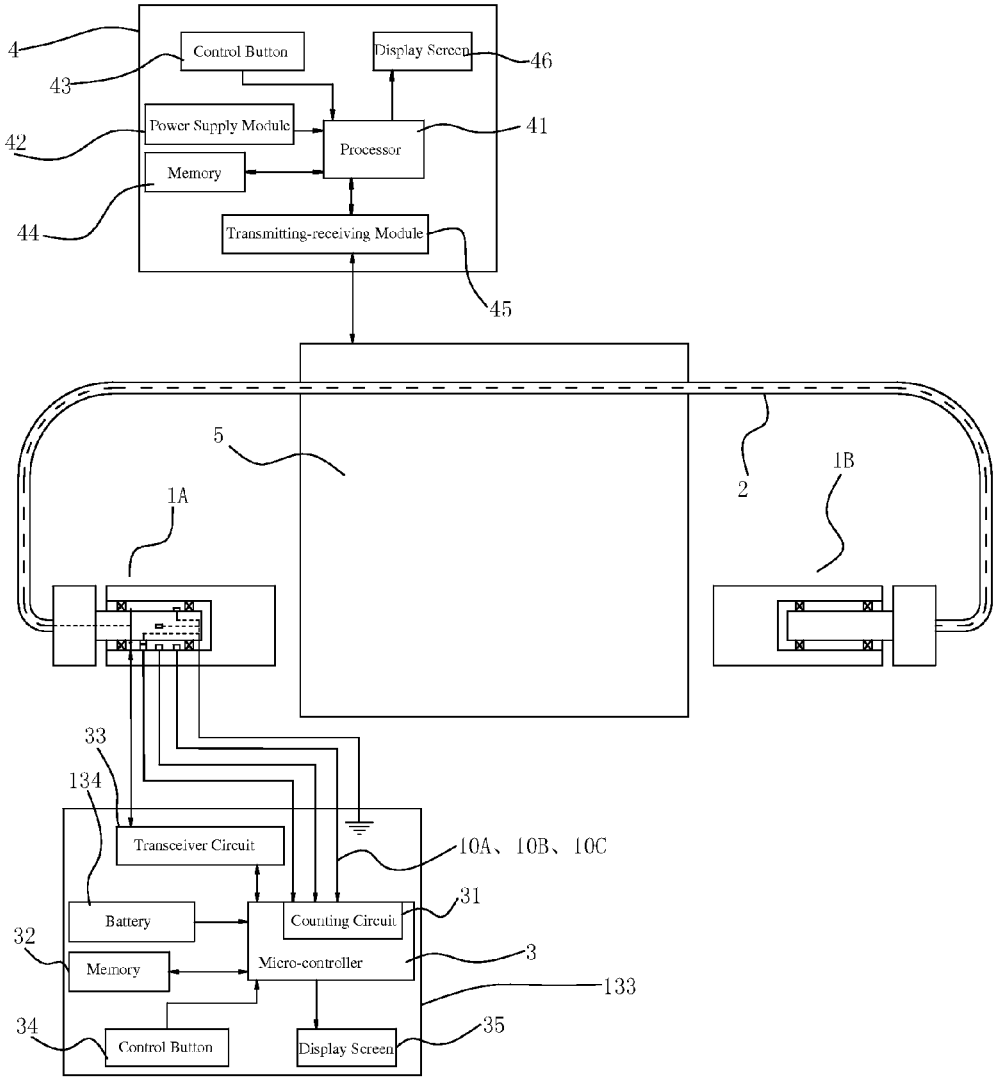

Both of the embodiment including a slideway structure shown in FIG. 2A to FIG. 2B and the embodiment including a magnet structure shown in FIG. 4A to FIG. 4B are similar to the embodiment of FIG. 1 except their detecting principles. The one of FIG. 2A to FIG. 2B is: the rotating body 11 has three circular slideways 111A, 112A, 113A arranged on different positions along the axial direction of the rotating body. Eeach circular slideway has one sensing point arranged therein, each sensing point being connected with a common signal terminal (it also is a ground terminal, which is connected with the common ground wire by the slideways) arranged on the rotating body. The fixed handle has three elastic sheets 101A, 102A, 103A (could be elastic conductive wires with rigidity or conductive elastic sheets and must be pressed in the circular slideways all the time) respectively corresponding to the circular slideways 111A, 112A, 113A, and each elastic sheet is connected with the micro-controller 3. When the rotating body 11 rotating for one circle, the sensing points (preferably being staggered 120 degrees with each other) arranged in the circular slideways 111A, 112A, 113A orderly contact with the corresponding elastic sheets 101A, 102A, 103A, thereby achieves the transmission of the electrical signals.

The one of FIG. 4A to FIG. 4B is: three magnetic sensors 101B, 102B, 103B are arranged on the fixed handle 10 and magnets 111B, 112B corresponding to the magnetic sensors 101B, 102B, 103B (because of the different install locations, the magnetic sensors 101B, 102B arranged on the circuit board 133B can share one magnet 111B) are arranged on the rotating body 11. Wherein, the magnetic sensor could be reed switch or Hall switch (also be called as Hall sensor). Its detection mode is the same as that of the above-mentioned embodiment.

Because the skipping rope handle achieves data exchange with the skipping rope console via non-earthed contact electromagnetic wave communication according to an embodiment, all of the fixed handles 10 of the above-mentioned three embodiments have a sliding ring sleeve 104 (including two sliding ring inner sleeve 104A and one sliding ring outer sleeve 104B), and the rotating body 11 has a sliding ring portion 114 cooperating with the sliding ring sleeve 104. The sliding ring sleeve 104 has a wire 105 fixed thereon, which is connected with the transceiver circuit and can keep connection with the sliding ring portion 114 of the rotating body 11 during the rotating body 11 rotating for 360 degree. The whole rotating body 11 is a conductor, thus the wire 105 is electrically connected with the rope 2 all the time. Wherein, the rope 2 is also a conductor.

FIG. 5 to FIG. 7C shows an electronic skipping rope competition system using non-earthed contact electromagnetic wave communication according to an embodiment of the present invention. In this embodiment, the skipping rope handle uses the structure of the above-mentioned embodiments, and its circuit includes: a counting circuit 31 connected with the detecting point and included in the micro-controller 3, and a memory 32, a transceiver circuit 33, a control button 34, a display screen 35, a buzzer, all of which are connected with the micro-controller, wherein the transceiver circuit 33 is electrically connected with the rope 2 via the wire 105, sliding ring portion 114 and rotating body 11. The transceiver circuit 33 includes a receiving amplifying circuit and a single transmitting IC chip, both of which are connected with the micro-controller. The receiving amplifying circuit is a multilevel triode amplifying circuit, the single transmitting IC chip is a SN8P2501-8 chip, and the micro-controller is a HT46R62 chip. The whole electronic skipping rope competition system includes a skipping rope console 4 and the above-mentioned electronic skipping rope structure. The skipping rope console 4 includes a processor 41 and a power supply module 42, a control bottom 43, a memory 44, a transmitting-receiving module 45, a display screen 46 and a buzzer, all of which are connected with the processor 41. The skipping rope console 4 is also connected with a conductive skipping blanket 5 which is connected with the transmitting-receiving module 45 and communicates with the rope 2 by a way of non-earthed contact electromagnetic wave communication. The signals transmitted between the conductive skipping blanket 5 and rope 2 are electrical pulse signals, the frequency of which is from 800 k to 2 MHz. Wherein, both of the transmission and reception of the electrical pulse signals are carried on alone. For example, the frequency of the electrical pulse signal being 1 MHz, the conductive skipping blanket 5 firstly transmits fifteen electrical pulse signals (spending 15 us), then stops for 15 us, and then transmits fifteen electrical pulse signals again and stops for 30 us (during such procedure, the conductive skipping blanket is on reception status without transmitting electrical pulse signals), so again and again. When the rope 2 contacts with the conductive skipping blanket 5, a corresponding electrical pulse signal (a very weak signal) is produced in the rope 2, which will be amplified by the detector of the circuit board arranged in the skipping rope handle and then be transmitted to the micro-controller for being processed. Determine whether the handle has detected the rope rotating for one circle. If it has, the same electrical pulse signal is transmitted to the rope, and then transmitted to the conductive skipping blanket by the rope, that is, such a procedure of transmission and reception will be carried out once during the rope contacts with the conductive skipping blanket. The electrical pulse signal can be replaced with other signals which can be identified by the two single chips, so as to avoid creating interference signals to bring counting error.

The single-wire non-earth two-way data transmission technology is used in the communication between the conductive skipping blanket and skipping rope handle. Its communication process will be described as follows:

1. Via the pin PA6, the main chip IC3 HT46R22 of the skipping blanket console makes the pin P5.4 of the single chip IC1 SN8P2501 send out a square wave with frequency of 1 MHz, amplitude of 5V and duty ratio of 50%. If the pin PA6 of the single chip IC3 HT46R22 outputs a low level, the pin P5.14 of the single chip IC1 SN8P2501 also outputs a low level, without producing frequency. According to this procedure, a group of modulating AC signals will be produced when the pin PA6 of the single chip IC3 HT46R22 outputs high and low levels, preferably, the frequency of the signal is 1 MHz.

2. By means of the contact of the conductive skipping blanket CN 3 and J9-5P of the skipping rope handle, the AC signal makes the receiving amplifying circuit of the handle produce induced voltage. The induced voltage is then changed by a LC detection plastic circuit to be a signal level with amplitude of 5V.

The transceiver circuit arranged on the skipping rope handle:

The conductive rope is connected to the fifth pin of J9, and the port SINGIN is an input port. The port SINGIN receives the AC voltage signal of the skipping blanket. The AC voltage signal detected 1 MHz signal via L6, C64 and C65. The 1 MHz signal is amplified by Q26, Q24 and rectified by Q25, Q27 to form an electrical pulse signal and then transmitted to the pin PA5 of the single chip IC1 HT46R62.

The skipping rope handle sends corresponding electrical pulse signal back to the conductive skipping blanket immediately if it detects that the rope has rotated for one circle (if the three detecting points detects out a same input signal orderly, it means that the rope has rotated for one circle); otherwise no information will be sent back. The data sent out by the skipping rope handle will be received by the transmitting-receiving module of the skipping rope console and then be processed and displayed.

The circuit principle of the skipping rope handle will be described as follows:

1. The single chip IC1 (HT46R62) arranged in the handle is equipped with a LCD display driver, which can display the visible contents such as score, consumed heat, counting of stopwatch and clock via the LCD CON2.

2. Five touch switches are arranged on the handle for different function settings.

3. Two AAA size batteries are provided for power supply, and the interface of power supply is J8.

4. Energy-saving technology is used. Only when the touch switch is pressed or the skipping rope is rotated will the handle be aroused. Otherwise the handle is normally on sleep mode. To save the quantity of electricity, the device Q23 is provided for causing the competition function to be not active in normal times (the pin PA1 of the single chip IC1 HT46R62 outputs high level to shut up the power supply of the receiving circuit).

5. The conductive sliding ring is provided for detecting the skipping for three times. The angle between each two adjacent contacts is 120 degrees, thereby avoiding producing inaccurate result of detecting.

6. Boost technique (U2, PT1301) is used for enhancing the transmittability of the skipping rope.

7. The handle uses buzzer LS2 to provide voice prompt about the operating state of the handle.

8. The memory (IC9, AT24C01) is provided for storing the identification numbers and scores.

9. The handle uses single-wire non-earth transmission technology to communicate with the conductive skipping blanket.

The circuit principle of the skipping rope console will be described as follows:

1. The skipping rope console uses five touch switches to achieve different function settings.

2. The power supply module is implemented by 6V5A lead-acid maintenance-free battery and DC24V. The IC2 TL494 is provided to achieve constant-current charge and floating charge. The bicolor LED LED1 is provided to indicate the state of charge.

3. A device U1 LM2575-ADJ is used as main power supply and outputs a voltage of 5V to the whole counting competition system. When the output voltage of LM2575-ADJ is lower than 4.7V, the device N1B772 starts to work to enhance the output voltage, thereby ensuring that the operating voltage of the skipping rope console is always more than 4.7V and then the skipping rope console can operate stably.

4. The display screen is composed of nixie tubes. The single chip IC3 HT26R22 transfers the serial data into parallel data by 74HC595 and then drives the nixie tubes to display the contents such as score and time and so on.

5. The skipping rope console uses active buzzer BZ1 to provide voice prompt about the system operating state.

6. The skipping rope console uses single-wire non-earth transmission technology to communicate with the handle.

7. The skipping rope console is capable of communicating with other consoles. A communication interface CN5 is provided for transmitting and receiving the data of the console so as to display the same content.

8. The skipping rope console is capable of controlling the next skipping rope console by CN2.

9. The skipping rope console is capable of being controlled by the preceding skipping rope console via CN1.

In the system of the present invention, there may be included an operating console with which the skipping rope console can synchronize. The display and operation functions of this operating console will be described as follows:

1. The operating console uses five touch switches to achieve different function settings.

2. The power supply module is implemented by 12V5A lead-acid maintenance-free battery and DC24V. The IC2 TL494 is provided to achieve constant-current charge and floating charge. The bicolor LED LED1 is provided to indicate the state of charge.

3. The device U1 LM2575-ADJ is used for outputting a voltage of 10V to the nixie tube system. When the output voltage of LM2575-ADJ is lower than 9.5V, the device N1B772 starts to work to enhance the output voltage, thereby ensuring that the operating voltage of the skipping rope console is always more than 9.5V and then the skipping rope console can operate stably. The device IC1 7805 is used for providing a voltage of 5V to the competition system.

4. The single chip IC3 HT26R22 transfers the serial data into parallel data by 74HC595 and then drives the nixie tubes to display the contents such as score and time and so on.

5. The operating console uses an active buzzer BZ1 to provide voice prompt about the system operating state.

6. The operating console uses CN2 to communicate with the skipping rope console and maintains data synchronization with it.

FIG. 8 to FIG. 10B show a wireless electronic skipping rope competition system using wireless communication mode of the present invention according to an embodiment (in this embodiment, the skipping blanket with contact-press type switches is used). Due to wireless communication modules being provided (preferably may be 2.4G wireless modules), the rope need not provide a communication function. Thus, in these kinds of embodiments, the skipping rope handle is not equipped with sliding ring portion and sliding ring sleeve. Wherein, the circuit of the electronic skipping rope structure including: micro-controller 3A includes a counting circuit 31A connected with the detecting point(s) and includes a memory 32A, a wireless communication module 33A, a control button 34A, a display screen 35A and a buzzer, all of which are connected with the micro-controller 3A. The wireless communication module 33A is wirelessly connected with a skipping rope console 5A. The whole electronic skipping rope competition system includes the skipping rope console 5A and the above-mentioned electronic skipping rope structure. The skipping rope console 5A includes a processor 51A and a power supply module 52A, a control bottom 53A, a memory 54A, a wireless communication module 55A, a display screen 56A, all of which are connected with the processor 51A. Its operating principle is: one of the skipping rope handles is equipped with a micro-controller (single-chip) which has counting function to counting the times of skipping by utilizing three detecting points, and then the signal of the skipping times is transmitted in real time to the skipping rope console via wireless communication module (preferable is a existing 2.4G module). Because each pair of skipping rope handles needs to build connection with the skipping rope console before use, the skipping rope skipping rope console could further includes a card reader 58A which is connected with the processor 51A. Every time before rope skipping, carry out an identification by reading card.

In the embodiment which uses wireless communication modules to achieve communication, the skipping blanket has a plurality of contact-press type switches 57A (uniform matrix distribution on the skipping blanket) which is connected with the processor 51A. Every time the jumping person hits the ground, the electrical signal will be produced once, such process is one way of counting. The contact-press type switches 57A may be composed of the switches arranged on a FPC (flexible print board) of the keyboard or other similar products. Because the skipping rope also will contact and press the skipping blanket, the contact-press type switches in the skipping blanket cannot be arranged in a simple coordinated way, but need to assign a number or ID to each contact-press type switch and carry out a judgment as follows: only when the contact-press type switches which produce signal form a layout similar to the shape of the footprints can it be determined that a landing action occurs. And when the contact-press type switches which produce signal form a layout similar to the shape of the arc line, it can be determined that the rope has hit the skipping blanket. As a further preferable embodiment, can merely use the skipping blanket which is provided with multiple contact-press type switches to achieve the counting of rope skipping, by means of calculating and analyzing the switch signals produced when the rope hits the skipping blanket. In other words, only when the layout of the contact-press type switches which produce signals is similar to the path line of the rope contacting with the skipping blanket can the counting be carried out, and if it shows a shape of the footprints or others, no counting is carried out. In order to improve the detection precision of the counting of rope skipping, the distance between the contact-press type switches cannot be designed too large, and in order to reduce the cost, the contact-press type switches should not be provided too many. Preferably, the distance between the contact-press type switches may be arranged in a range from 1 cm to 5 cm. To simplify the circuit structure and reduce the manufacturing cost of the skipping blanket, the skipping blanket can be divided into two regions, one of which is provided as a landing area for the jumping person and the other is provided as a contacting area for the rope.

Because of the variety of the skipping competition and examination, the wireless communication mode for counting is achieved by the electromagnetic signals with frequency of 2.4 GHz, and the non-earthed contact single-line communication mode is achieved by the low-frequency and zero-distance electromagnetic wave communication with frequency from 800 KHz to 2 MHz. The former can be applied on fancy rope skipping game, such as a rope skipping like this: every time the jumping person jumps up, he/she need to rotating the rope for two circles, three circles, four circles or even more.

In another embodiment, only the wireless communication module is used and the skipping blanket is removed, that is, the counting result is produced by the skipping rope handle and then transmitted to the skipping rope console by the wireless communication module, and the landing of the jumper will not be counted. In still another embodiment, only the skipping blanket with contact-press type switches is used, that is, only the action of the rope hitting the skipping blanket will be counted without needing the counting function of the skipping rope handle (in such an embodiment, the count may be ended or be cumulative when the jumper pauses halfway, and these different functions can be realized by rewriting the programs of the micro-controllers or other similar chips).

In conclusion, with respect with the electronic skipping rope structure of the present invention, due to the three detecting points arranged in 360 degree, only when the rope has completely rotated for one circle, can the rope skipping be counted once. Thus the counting of rope skipping achieved by the skipping rope handle is accurate. Additionally, it has simple structure and low cost, and is easy to be applied on various competitions and examinations of rope skipping. With respect to the electronic skipping rope competition system of the present invention, it can transmit the counting results of the skipping rope handles to a console in real time by such detection modes as non-earthed contact electromagnetic wave communication, wireless communication or contact-press type switches, such that results are displayed to the examiner or audiences via a display screen of the console. The user is unaffected when skipping and operation is convenient.

Above descriptions of embodiments are provided for further illustrating the technical content of the present invention, so as to facilitate understanding and it is to be understood that the invention is not to be limited to the disclosed embodiments. Any technique extension and recreation according to the present invention should be included within the scope of protection of the invention.

What is claimed is:

1. An electronic skipping rope structure, comprising two skipping rope handles and a rope arranged between the two skipping rope handles, the skipping rope handles each comprising a fixed handle for being grasped by the hands of a jumping person and a rotating body movably connected with the fixed handle, the rotating body being connected with the rope, wherein a sensing point is arranged on the rotating body of one skipping rope handle, at least two detecting points corresponding to the sensing point are arranged on the fixed handle of said skipping rope handle, and a micro-controller electrically connected with the detecting points is arranged inside said fixed handle;

wherein the number of said detecting points is three; and three circular slideways are arranged at different positions along the axial direction of said rotating body, each circular slideway having one sensing point arranged therein, each sensing point being connected with a common signal terminal arranged on the rotating body; and the fixed handle has three elastic sheets respectively corresponding to said three circular grooves, each of said elastic sheets being connected with the micro-controller.

2. The electronic skipping rope structure according to claim 1, wherein said rotating body has a protruding block arranged thereon and said fixed handle has three elastic sheet switches arranged at a circular position corresponding to the protruding block, said three elastic sheet switches all being connected with the micro-controller; and said elastic sheet switches constitutes the detecting points.

3. The electronic skipping rope structure according to claim 1, wherein three magnetic sensors are arranged on said fixed handle, said rotating body has magnets corresponding to the magnetic sensors, said magnetic sensors constitute the detecting points and said magnets constitute the sensing points.

4. The electronic skipping rope structure according to claim 1, wherein the micro-controller comprises a counting circuit connected with the detecting points, and further comprises a memory, a wireless communication module, a control button, a display screen and a buzzer all connected with the micro-controller, the wireless communication module being wirelessly connected with a skipping rope console.

5. The electronic skipping rope structure according to claim 1, wherein the rope is a conductive body; the micro-controller comprises a counting circuit connected with the detecting points, and further comprises a memory, a transceiver circuit, a control button, a display screen and a buzzer all connected with the micro-controller, the transceiver circuit being electrically connected with the rope.

6. An electronic skipping rope competition system, comprising a skipping rope console and an electronic skipping rope structure as claimed in claim 1, wherein the skipping rope console comprises a processor and a power supply module, a control bottom, a memory, a transmitting-receiving module and a display screen all connected with the processor, and said skipping rope console is connected with an conductive skipping blanket connected with the transmitting-receiving module, said conductive skipping blanket communicating with the rope via non-earthed contact electromagnetic wave communication mode, and the signal transmitted between the conductive blanket and rope being pulse electrical signal with frequency between 800 k and 2 MHz.

7. An electronic skipping rope competition system, comprising a skipping rope console and an electronic skipping rope structure as claimed in claim 1, wherein the skipping rope console comprises a processor and a power supply module, a control bottom, a memory, a transmitting-receiving module and a display screen all connected with the processor, and said skipping rope console is connected with an conductive skipping blanket connected with the transmitting-receiving module, said conductive skipping blanket communicating with the rope via non-earthed contact electromagnetic wave communication mode, and the signal transmitted between the conductive blanket and rope being pulse electrical signal with frequency between 800 k and 2 MHz.

8. An electronic skipping rope competition system, comprising a skipping rope console and an electronic skipping rope structure as claimed in claim 1, wherein the skipping rope console comprises a processor and a power supply module, a control bottom, a memory, a transmitting-receiving module and a display screen all connected with the processor, and said skipping rope console is connected with an conductive skipping blanket connected with the transmitting-receiving module, said conductive skipping blanket communicating with the rope via non-earthed contact electromagnetic wave communication mode, and the signal transmitted between the conductive blanket and rope being pulse electrical signal with frequency between 800 k and 2 MHz.

9. An electronic skipping rope competition system, comprising a skipping rope console and an electronic skipping rope structure as claimed in claim 2, wherein the skipping rope console comprises a processor and a power supply module, a control bottom, a memory, a transmitting-receiving module and a display screen all connected with the processor, and said skipping rope console is connected with an conductive skipping blanket connected with the transmitting-receiving module, said conductive skipping blanket communicating with the rope via non-earthed contact electromagnetic wave communication mode, and the signal transmitted between the conductive blanket and rope being pulse electrical signal with frequency between 800 k and 2 MHz.

10. An electronic skipping rope competition system, comprising a skipping rope console and an electronic skipping rope structure as claimed in claim 3, wherein the skipping rope console comprises a processor and a power supply module, a control bottom, a memory, a transmitting-receiving module and a display screen all connected with the processor, and said skipping rope console is connected with an conductive skipping blanket connected with the transmitting-receiving module, said conductive skipping blanket communicating with the rope via non-earthed contact electromagnetic wave communication mode, and the signal transmitted between the conductive blanket and rope being pulse electrical signal with frequency between 800 k and 2 MHz.

11. An electronic skipping rope competition system, comprising a skipping rope console and an electronic skipping rope structure as claimed in claim 5, wherein the skipping rope console comprises a processor and a power supply module, a control bottom, a memory, a transmitting-receiving module and a display screen all connected with the processor, and said skipping rope console is connected with an conductive skipping blanket connected with the transmitting-receiving module, said conductive skipping blanket communicating with the rope via non-earthed contact electromagnetic wave communication mode, and the signal transmitted between the conductive blanket and rope being pulse electrical signal with frequency between 800 k and 2 MHz.

12. An electronic skipping rope competition system comprising a skipping rope console and an electronic skipping rope structure as claimed in claim 1, wherein the skipping rope console comprises a processor and a power supply module, a control bottom, a memory, a wireless communication module and a display screen , all of which are connected with the processor.

13. An electronic skipping rope competition system comprising a skipping rope console and an electronic skipping rope structure as claimed in claim 1, wherein the skipping rope console comprises a processor and a power supply module, a control bottom, a memory, a wireless communication module and a display screen , all of which are connected with the processor.

14. An electronic skipping rope competition system comprising a skipping rope console and an electronic skipping rope structure as claimed in claim 1, wherein the skipping rope console comprises a processor and a power supply module, a control bottom, a memory, a wireless communication module and a display screen , all of which are connected with the processor.

15. An electronic skipping rope competition system comprising a skipping rope console and an electronic skipping rope structure as claimed in claim 2, wherein the skipping rope console comprises a processor and a power supply module, a control bottom, a memory, a wireless communication module and a display screen , all of which are connected with the processor.

16. An electronic skipping rope competition system comprising a skipping rope console and an electronic skipping rope structure as claimed in claim 3, wherein the skipping rope console comprises a processor and a power supply module, a control bottom, a memory, a wireless communication module and a display screen , all of which are connected with the processor.

17. An electronic skipping rope competition system comprising a skipping rope console and an electronic skipping rope structure as claimed in claim 4, wherein the skipping rope console comprises a processor and a power supply module, a control bottom, a memory, a wireless communication module and a display screen , all of which are connected with the processor.

18. An electronic skipping rope competition system comprising a skipping rope console and an electronic skipping rope structure as claimed in claim 1, wherein the skipping rope console comprises a processor and a power supply module, a control bottom, a memory, a display screen and more than one contact-press type switches, all of which are connected with the processor, and further comprises a skipping blanket for containing the contact-press type switches.

* * * * *